US011060492B2

(12) United States Patent
Lee

(10) Patent No.: US 11,060,492 B2
(45) Date of Patent: Jul. 13, 2021

(54) FUEL INJECTOR FOR ENGINE

(71) Applicants: Hyundai Motor Company, Seoul (KR); KIA Motors Corporation, Seoul (KR)

(72) Inventor: Hyeon Jin Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 216 days.

(21) Appl. No.: 16/380,820

(22) Filed: Apr. 10, 2019

(65) Prior Publication Data

US 2020/0158066 A1 May 21, 2020

(30) Foreign Application Priority Data

Nov. 20, 2018 (KR) ..... 10-2018-0143308

(51) Int. Cl.

| | |
|---|---|
| ***F02M 47/02*** | (2006.01) |
| ***F02M 63/00*** | (2006.01) |
| ***B05B 1/30*** | (2006.01) |
| ***F02M 51/06*** | (2006.01) |
| ***F02M 59/46*** | (2006.01) |

(52) U.S. Cl.

CPC ..... *F02M 47/027* (2013.01); *B05B 1/3053* (2013.01); *F02M 51/0625* (2013.01); *F02M 59/466* (2013.01); *F02M 63/0021* (2013.01); *F02M 63/0022* (2013.01); *F02M 63/0049* (2013.01); *F02M 63/0064* (2013.01); *F02M 2200/28* (2013.01)

(58) Field of Classification Search

CPC ..... F02M 63/0022; F02M 63/0049; F02M 63/0064; F02M 47/027; F02M 51/0625; F02M 59/466; F02M 2200/28; B05B 1/3053

USPC ..... 123/490

See application file for complete search history.

(56) References Cited

U.S. PATENT DOCUMENTS

| | | | | |
|---|---|---|---|---|
| 6,892,971 | B2 * | 5/2005 | Rieger | F02M 51/0617 239/585.1 |
| 7,093,778 | B1 * | 8/2006 | Hellmich | B05B 9/0413 239/585.1 |
| 2003/0080217 | A1 * | 5/2003 | Boecking | F02M 55/008 239/533.2 |
| 2004/0041038 | A1 * | 3/2004 | Delaney | F02M 61/162 239/585.1 |
| 2004/0065304 | A1 * | 4/2004 | Xi | F02M 51/04 123/497 |
| 2009/0241650 | A1 * | 10/2009 | Kondo | F02M 61/14 73/114.43 |

FOREIGN PATENT DOCUMENTS

| | | | | |
|---|---|---|---|---|
| GB | 2341893 A | * | 3/2000 | F02M 45/12 |
| KR | 10-1990-0008163 A | | 6/1990 | |

* cited by examiner

*Primary Examiner* — Mahmoud Gimie

(74) *Attorney, Agent, or Firm* — Morgan, Lewis & Bockius LLP

(57) ABSTRACT

A fuel injector for an engine includes: a solenoid unit including a plurality of solenoids that can be separately controlled; a valve body having a control chamber connected with a supply throttle and a return throttle; and a plurality of armatures disposed between the solenoid unit and the valve body to be able to adjust the amount of fuel that is discharged through the return throttle by being driven by the solenoids of the solenoid unit.

10 Claims, 7 Drawing Sheets

FUEL INJECTOR FOR ENGINE

CROSS REFERENCE TO RELATED APPLICATION

The present application claims priority of Korean Patent Application No. 10-2018-0143308 filed on Nov. 20, 2018, the entire contents of which are incorporated herein for all purposes by this reference.

BACKGROUND

1. Field

The present disclosure relates to fuel injector for an engine, and more particularly, to the structure of an injector.

2. Description of the Prior Art

In a diesel engine, a controller, in general, supplies fuel to a combustion chamber by simply controlling only the fuel injection period of an injector with the pressure of a fuel rail set in accordance with the operation conditions of the engine.

Accordingly, it is difficult to control a fuel injection rate ($mm^3/ms$) that is the amount of sprayed fuel per unit time within a unit injection time in which a controller controls an injector and fuel is injected while a nozzle is opened once.

Meanwhile, the matters which have been described as the technology corresponding to the background of the present disclosure are only for assisting with an understanding of the background of the present disclosure, and should not be considered as the prior art already known to those skilled in the art.

SUMMARY

One aspect of the invention provides a fuel injector for an engine, the fuel injector being able to improve fuel efficiency, reduce noxious exhaust substances, and significantly decrease vibration and noise of the engine by producing an optimal fuel combustion condition in a combustion chamber by actively changing a fuel injection rate thereof in accordance with operation conditions of an engine even within a unit injection period thereof.

In view of the above aspect, a fuel injector for an engine according to the present disclosure may include: a solenoid unit including a plurality of solenoids that can be separately controlled; a valve body having a control chamber connected with a supply throttle and a return throttle; and a plurality of armatures disposed between the solenoid unit and the valve body to be able to adjust the amount of fuel that is discharged through the return throttle by being driven by the solenoids of the solenoid unit.

The solenoid unit may include an inner solenoid and an outer solenoid that are respectively disposed inside and outside and are coaxially formed, and the armatures may include an inner armature that is driven by the inner solenoid and an outer armature that is driven by the outer solenoid.

The inner armature and the outer armature may be configured such that the inner armature is operated when the outer armature is driven by the outer solenoid, thereby contributing to returning fuel through the return throttle.

The inner armature may have a flange radially extending outward on a cylinder portion surrounding an armature bolt, and the outer armature may have a cup portion formed on a sleeve portion surrounding the cylinder portion of the inner armature, and surrounding the flange to be able to move the flange toward the solenoid unit.

The inner height of the cup portion of the outer armature may be larger than the thickness of the flange of the inner armature with ends, which face the inner armature and the outer armature, of the inner solenoid and the outer solenoid positioned in the same plane.

A seat surrounding the sleeve portion of the outer armature may be formed on the top of the valve body, and a plurality of discharge holes for returning fuel that is discharged through the return throttle may be formed through the seat.

The downward extension length of the sleeve portion of the outer armature from the cup portion with the bottom of the cup portion of the outer armature supported by the top of the seat of the valve body may be limited within a range in which the discharge holes can be open.

The sleeve portion of the outer armature may be formed to protrude toward the discharge holes with the bottom of the cup portion of the outer armature supported by the top of the seat of the valve body in order to be able to make sure that the discharge holes are open and to partially interfere with flow of the fuel that flows from the return throttle to the discharge holes.

The length of the cylinder portion of the inner armature may be determined to be able to cover the return throttle and the discharge holes with the bottom of the flange of the inner armature supported by the top of the cup portion of the outer armature.

A valve spring that elastically supports the inner armature toward the valve body may be disposed between the solenoid unit and the inner armature.

Another aspect of the invention provides a fuel injector for an engine, the fuel injector comprising: a solenoid unit including a plurality of solenoids; a valve body having a return throttle, at least a discharge hole and a control chamber serially connected to the return throttle and the discharge hole for providing a return channel; and a plurality of armatures disposed between the solenoid unit and the valve body, wherein each of the plurality of armatures corresponds one of the plurality of solenoids and is configured to move by the operation of the corresponding solenoid, wherein the plurality of solenoids are configured to independently operate by at least one control signal such that the operation of one or more of the plurality of solenoids causes one or more of the plurality of armatures to move for adjusting opening of the return channel and further such that the amount of fuel that is discharged through the return throttle by the operation of the plurality of solenoids is controlled.

According to the fuel injector for an engine of the present disclosure, it is possible to improve fuel efficiency, reduce noxious exhaust substances, and significantly decrease vibration and noise of the engine by producing an optimal fuel combustion condition in a combustion chamber by actively changing a fuel injection rate thereof in accordance with operation conditions of an engine even within a unit injection period thereof.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF EMBODIMENTS

Embodiments of the invention are now described with reference to the accompanying drawings. The terminology used in the description presented herein is not intended to be interpreted in any limited or restrictive manner, simply because it is being utilized in conjunction with a detailed description of certain embodiments of the invention.

In a diesel engine, if the fuel injection rate of an injector can be appropriately controlled in accordance with the operation conditions of an engine within a unit injection time, fuel efficiency can be improved due to more effective combustion, noxious substances such as exhaust gas can be reduced, and vibration and noise of an engine can be considerably decreased.

Figure 1:
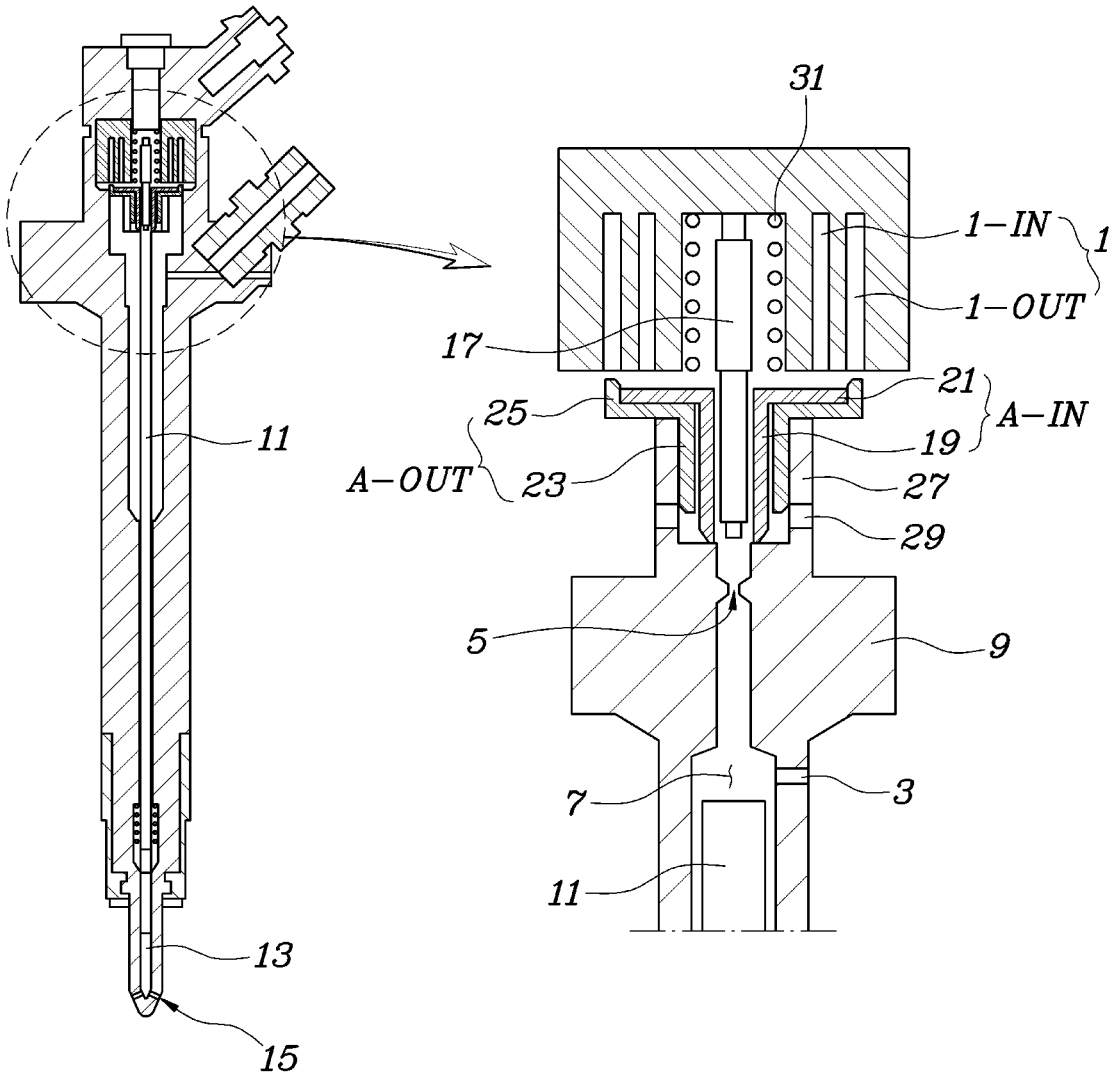
FIG. 1 is a view showing a fuel injector for an engine according to the present disclosure.

Referring to FIG. 1, an embodiment of a fuel injector for an engine according to the present disclosure includes: a solenoid unit 1 including a plurality of solenoids that can be separately controlled; a valve body 9 having a control chamber 7 connected with a supply throttle 3 and a return throttle 5; and a plurality of armatures disposed between the solenoid unit 1 and the valve body 9 to be able to adjust the amount of fuel that is discharged through the return throttle 5 by being driven by the solenoids of the solenoid unit 1.

In embodiments, it is possible to actively adjust the amount of fuel that is discharged through the return throttle or return throttle hole 5 from the control chamber 7 within a unit injection period by operating a plurality of armatures using a plurality of solenoids.

In embodiments, the injector may include the configuration of typical injectors that are used for existing common rail fuel injection system. In embodiments, the injector is configured such that when a control plunger 11 under the control chamber 7 is moved up and down by a change in hydraulic pressure in the control chamber 7, a needle 13 under the control plunger 11 is moved up and down, thereby a nozzle 15 is opened and close and fuel is injected.

In embodiments, when fuel in the control chamber 7 is discharged through the return throttle 5 by the solenoid unit 1 and pressure is decreased, the control plunger 11 under the control chamber 7 is moved up, the needle 13 under the control plunger 11 is moved up, and the nozzle 15 is opened, so the fuel is injected into a combustion chamber. In contrast, when the return throttle 5 is closed and the pressure in the control chamber 7 is increased by fuel pressure supplied from the supply throttle 3, the control plunger 11 is moved down and the needle 13 is moved down, so the nozzle 15 is closed.

Obviously, the solenoid unit 1 is configured such that a controller performs electrical control in accordance with operation conditions of an engine.

In this embodiment, the solenoid unit 1 includes an inner solenoid 1-IN and an outer solenoid 1-OUT that are respectively disposed inside and outside and are coaxially formed, and the armatures include an inner armature A-IN that is driven by the inner solenoid 1-IN and an outer armature A-OUT that is driven by the outer solenoid 1-OUT.

In embodiments, the inner armature A-IN is driven to move up in the drawings by the inner solenoid 1-IN and the outer armature A-OUT is driven to move up by the outer solenoid 1-OUT.

The inner armature A-IN and the outer armature A-OUT are configured such that the inner armature A-IN is operated when the outer armature A-OUT is driven by the outer solenoid 1-OUT, thereby contributing to returning fuel through the return throttle 5.

In embodiments, when the inner solenoid 1-IN is powered, the inner armature A-IN is moved up independently regardless of the outer armature A-OUT, but when the outer solenoid 1-OUT is powered, the outer armature A-OUT is moved up and operates the inner armature A-IN.

The inner armature A-IN has a flange 21 radially extending outward on a cylinder portion 19 surrounding an armature bolt 17 and the outer armature A-OUT has a cup portion 25 formed on a sleeve portion 23 surrounding the cylinder portion 19 of the inner armature A-IN, and surrounding the flange 21 to be able to move the flange 21 toward the solenoid unit 1.

In embodiments, when a current is applied only to the outer solenoid 1-OUT and the outer armature A-OUT operates the inner armature A-IN, the cup portion 25 of the outer armature A-OUT pushes up the flange 21 of the inner armature A-IN, so the inner armature A-IN is operated.

Figure 2:
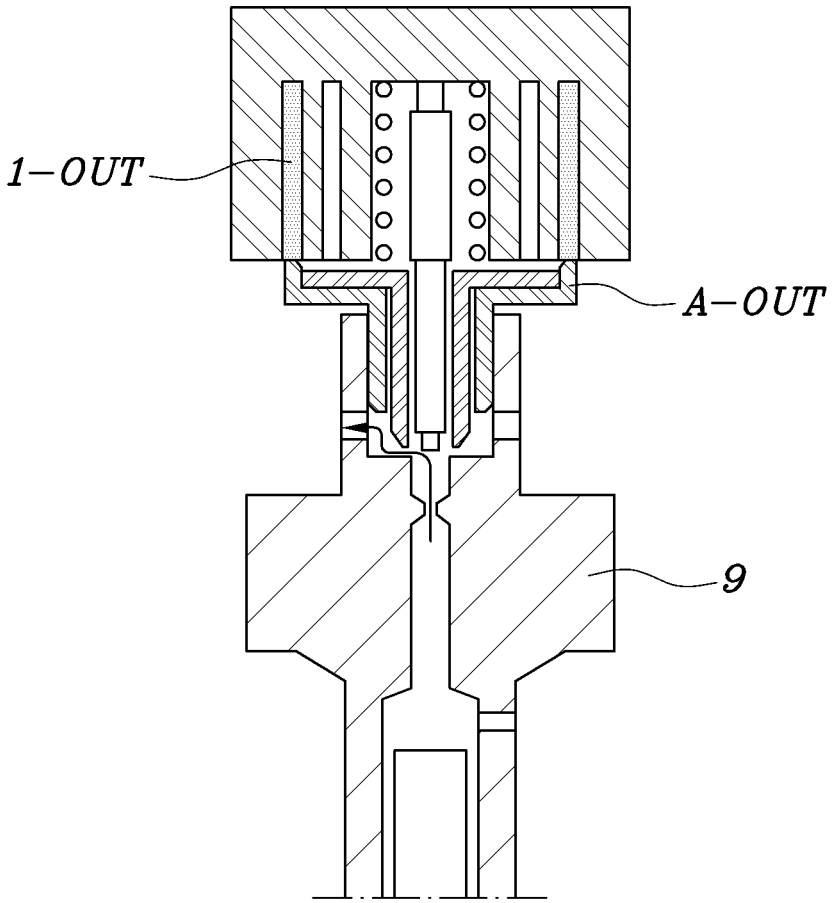
FIG. 2 is a view showing a state when a current has been applied to only an outer solenoid from the injector of FIG. 1.

FIG. 2 is a view showing a state when a current has been applied to only the outer solenoid 1-OUT. The top of the cup portion 25 of the outer armature A-OUT comes in close contact with the bottom of the outer solenoid 1-OUT and operates the inner armature A-IN and the bottom of the cylinder portion 19 of the inner armature A-IN moves off the valve body 9, so fuel can be discharged through the return throttle 5.

Figure 3:
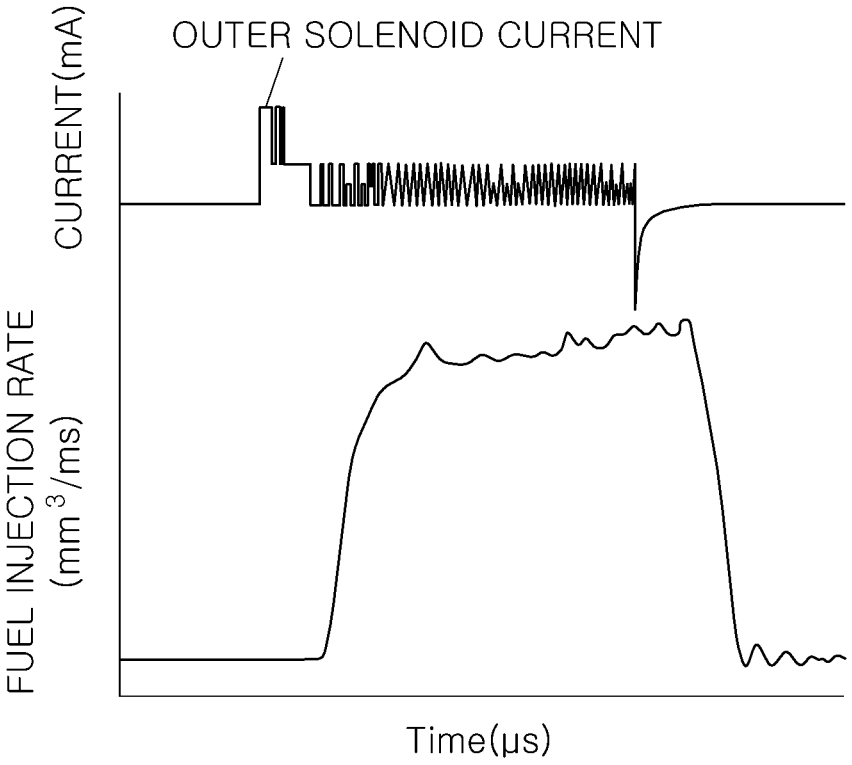
FIG. 3 is a graph showing a fuel injection rate according to time for a unit injection period by operation of a solenoid unit as in FIG. 2.
Figure 4:
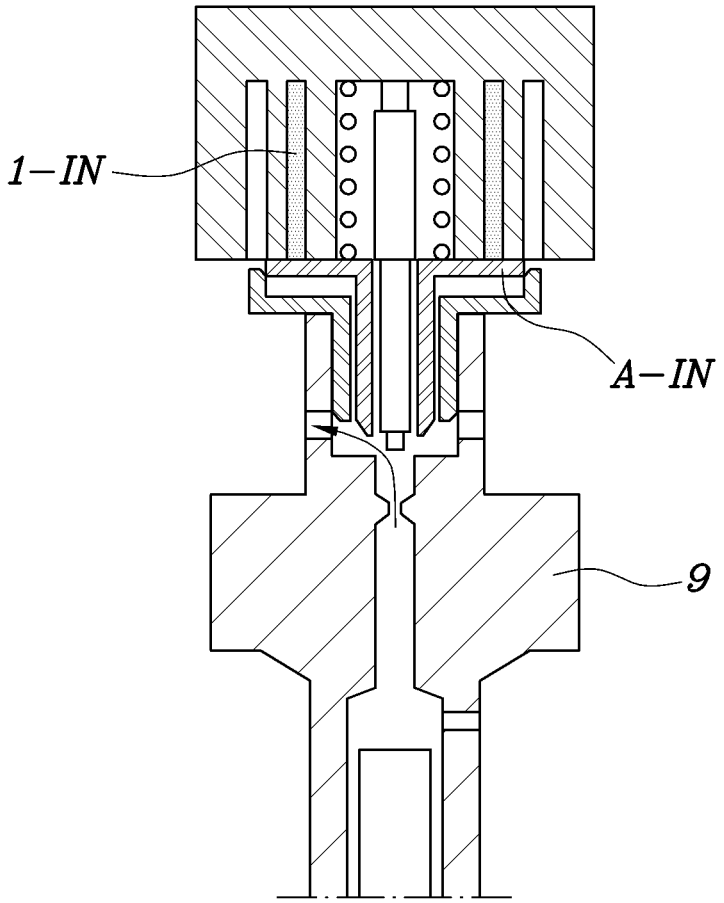
FIG. 4 is a view showing a state when a current has been applied to only an inner solenoid from the injector of FIG. 1.

In FIG. 4 showing an example in which a current has been applied only to the inner solenoid 1-IN, the inner armature A-IN has been moved up further than that of FIG. 3 in close contact with the bottom of the inner solenoid 1-IN.

As described above, when a current has been applied only to the inner solenoid 1-IN, as compared with when a current has been applied only to the outer solenoid 1-OUT, the inner armature A-IN is further moved up, so fuel can be more easily discharged through the return throttle 5, which is made possible because, as shown in FIGS. 2 and 4, the inner height or depth of the cup portion 25 of the outer armature A-OUT is set larger than the thickness of the flange 21 of the inner armature A-IN with the ends, which face the inner armature A-IN and the outer armature A-OUT, of the inner solenoid 1-IN and the outer solenoid 1-OUT positioned in the same plane.

In embodiments, when the inner solenoid operates, the inner armature moves a first distance longer than a second distance that the inner armature moves when only the outer solenoid operates.

In embodiments, in the state of FIG. 2, the gap defined between the top of the flange 21 of the inner armature A-IN and the inner solenoid 1-IN enables the inner armature A-IN to move up further when a current is applied only to the inner solenoid 1-IN than when a current is applied only to the outer solenoid 1-OUT, as described above.

In this embodiment, a seat 27 surrounding the sleeve portion 23 of the outer armature A-OUT is formed on the top of the valve body 9 and a plurality of discharge holes 29 for returning fuel that is discharged through the return throttle 5 is formed through the seat 27.

The downward extension length or depth of the sleeve portion 23 of the outer armature A-OUT from the cup portion 25 with the bottom of the cup portion 25 of the outer armature A-OUT supported by the top of the seat 27 of the valve body 9 is limited within a range in which the discharge holes 29 can be open.

Further, the sleeve portion 23 of the outer armature A-OUT may be formed to protrude toward the discharge holes with the bottom of the cup portion 25 of the outer armature A-OUT supported by the top of the seat 27 of the valve body 9 in order to be able to make sure that the discharge holes 29 are open and to partially interfere with flow of the fuel that flows from the return throttle 5 to the discharge holes 29.

According to the protrusive shape of the sleeve portion 23 described above, as can be seen by comparing FIGS. 4 and 6, since a current has been commonly applied to the inner solenoid 1-IN, flow of fuel to the discharge holes 29 from the return throttle 5 is basically allowed, but the fuel can more feely flow in the case of FIG. 6 in which a current has been applied to the outer solenoid 1-OUT too, as compared with the case of FIG. 4 in which a current has not been applied to the outer solenoid 1-OUT. Further flow of the fuel is relatively partially interrupted in the case of FIG. 4, so the fuel can more smoothly return, as compared with the state of FIG. 2, but the flow of the fuel is limited, as compared with the state of FIG. 6. Accordingly, the variable control of a fuel injection rate to be described blow can be more freely performed.

On the other hand, the length of the cylinder portion 19 of the inner armature A-IN is determined to be able to cover the return throttle 5 and the discharge holes 29 with the bottom of the flange 21 of the inner armature A-IN supported by the top of the cup portion 25 of the outer armature A-OUT.

Accordingly, when a current has not been applied to both the inner solenoid 1-IN and the outer solenoid 1-OUT, return of fuel through the return throttle 5 is substantially interrupted by the cylinder portion 19 of the inner armature A-IN. Further, referring to FIG. 4, when a current has been applied to the inner solenoid 1-IN and the inner armature A-IN has been moved up, the amount of fuel that is discharged to the discharge holes 29 through the return throttle 5 is the maximum regardless of the position of the outer armature A-OUT.

A valve spring 31 that elastically supports the inner armature A-IN toward the valve body 9 is disposed between the solenoid unit 1 and the inner armature A-IN. Accordingly, as shown in FIG. 1, when a current is not applied to the outer solenoid 1-OUT and the inner solenoid 1-IN, the inner armature A-IN is elastically supported toward the valve body 9 together with the outer solenoid 1-OUT by the elasticity of the valve spring 31.

The armature bolt 17 disposed in the center of the inner armature A-IN guides the inner armature A-IN up and down by moving up and down with the inner armature A-IN that is moved up and down.

The operation of the fuel injector having this configuration of the present disclosure is described with reference to FIGS. 2 to 7.

FIG. 2 is a view showing a state when a current has been applied only to the outer solenoid 1-OUT, as described above, and FIG. 3 is a view showing a current of the outer solenoid 1-OUT and a fuel injection rate of an injector according to time in the state shown in FIG. 2.

As described above, even though a current has been applied only to the outer solenoid 1-OUT, the inner armature A-IN is slightly moved up by the cup portion 25 of the outer armature A-OUT such that fuel that has passed through the return throttle 5 can return through the discharge holes 29, so the pressure of the control chamber 7 decreases. Accordingly, the control plunger 11 is moved up and the needle 13 is moved up, so high-pressure fuel is injected into a combustion chamber through the nozzle 15.

Figure 5:
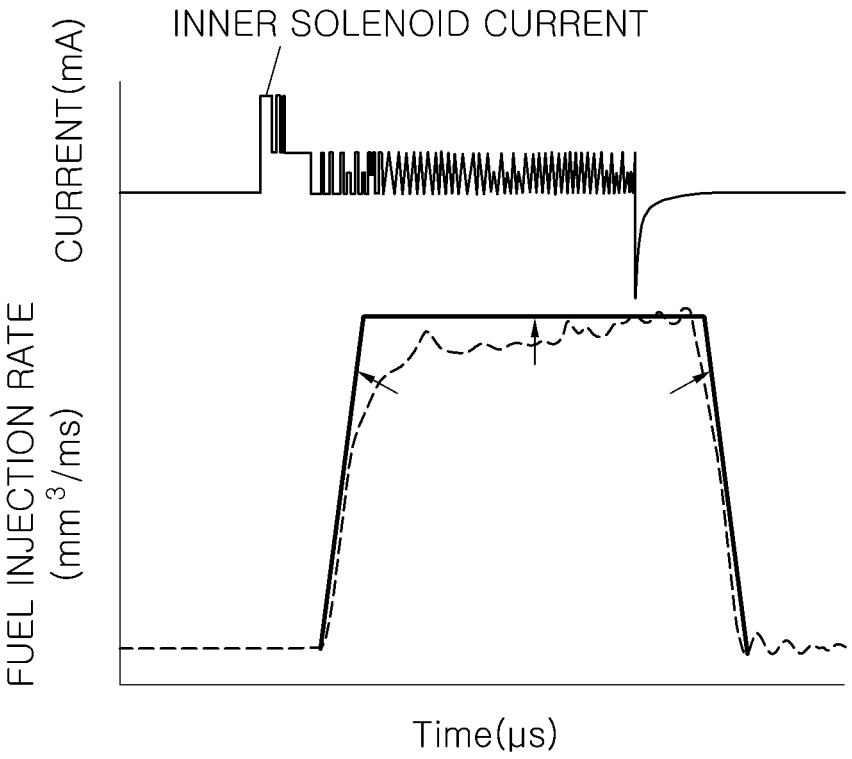
FIG. 5 is a graph showing a fuel injection rate according to time for a unit injection period by operation of a solenoid unit as in FIG. 4.

FIG. 4 is a view showing a state when a current has been applied only to the inner solenoid 1-IN and FIG. 5 is a view showing a current of the outer solenoid 1-OUT and a fuel injection rate of an injector according to time in the state shown in FIG. 5.

When a current has been applied only to the inner solenoid 1-IN, only the inner armature A-IN is moved up into the state shown in FIG. 4 and the return amount of fuel through the return throttle 5 depends on the rising amount of the inner armature A-IN because the bottom of the sleeve portion 23 of the outer armature A-OUT basically does not block the discharge holes 29, as described above. In this case, the inner armature A-In is maximally moved up and the amount of fuel returning to the discharge holes 29 through the return throttle 5 is the maximum, so the pressure of the control chamber 7 drops more rapidly than the case of FIG. 2. Accordingly, the control plunger 11 is moved up faster, so the fuel injection rate through the nozzle 15 is relatively rapidly increased and a larger fuel injection rate than that of FIG. 2 can be achieved.

Figure 6:
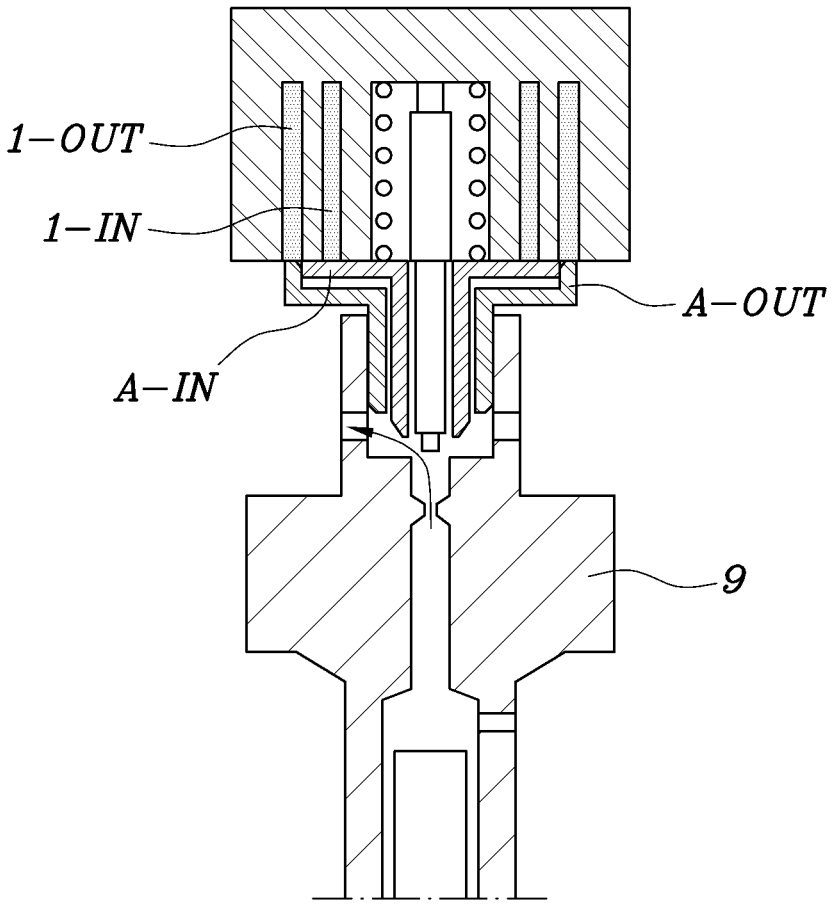
FIG. 6 is a view showing a state when a current has been applied to an inner solenoid after a current is applied to an outer solenoid from the injector of FIG. 1.
Figure 7:
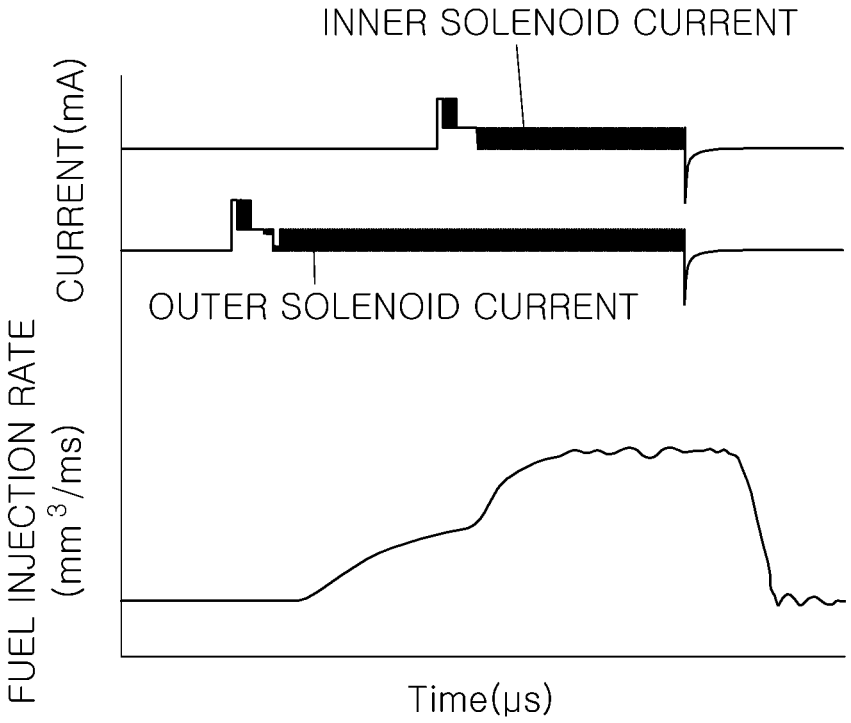
FIG. 7 is a graph showing a fuel injection rate according to time for a unit injection period by operation of a solenoid unit as in FIG. 6.

FIG. 6 shows an example of injection control that is achieved by combining the characteristics when only the outer solenoid 1-OUT is operated and the characteristics when only the inner solenoid 1-IN is operated and shows a state when a current has been applied first only to the outer solenoid 1-OUT and then a current has been sequentially applied to the inner solenoid 1-IN too and FIG. 7 is a view showing currents of the outer solenoid 1-OUT and the inner solenoid 1-IN and the fuel injection rate of an injector according to time in this case.

In this case, as shown in FIG. 7 it can be seen that the fuel injection rate is relatively low when a current was applied only to the outer solenoid 1-OUT in the early stage and the fuel injection rate is relatively high when a current was applied to the inner solenoid 1-IN too. Accordingly, it can be seen that the fuel injection rate can be changed within a unit injection period.

In embodiments, a fuel injector for an engine includes a plurality of solenoids, a valve body and a plurality of armatures. The valve body has a return throttle, at least a discharge hole and a control chamber serially connected to the return throttle and the discharge hole for providing a return channel. The plurality of armatures are disposed between the solenoid unit and the valve body. Each of the plurality of armatures corresponds one of the plurality of solenoids and is configured to move by the operation of the corresponding solenoid. The plurality of solenoids are configured to independently operate by at least one control signal such that the operation of one or more of plurality of solenoids causes one or more of the plurality of armatures to move for adjusting opening of the return channel and further such that the amount of fuel that is discharged through the return throttle by the operation of the plurality of solenoids is controlled.

Obviously, it is possible to change the fuel injection rate in various ways by changing the time distribution and the sequence that apply a current to the outer solenoid 1-OUT and the inner solenoid 1-IN in various ways. By changing the fuel injection rate in this way, it is possible to change the fuel injection rate in optimal patterns in accordance with the operation conditions of an engine.

Therefore, by controlling an injector while changing the fuel injection rate in patterns that are more suitable for the operation conditions of an engine using the injector of the present disclosure, it is possible to improve the fuel efficiency of a vehicle, reduce noxious exhaust substances, and remarkably decrease vibration and noise of the engine.

Although the present disclosure has been described and illustrated with reference to the particular embodiments thereof, it will be apparent to those skilled in the art that various improvements and modifications of the present disclosure can be made without departing from the technical idea of the present disclosure provided by the following claims.

What is claimed is:

1. A fuel injector for an engine, the fuel injector comprising:

a solenoid unit including a plurality of solenoids that can be separately controlled;

a valve body having a control chamber connected with a supply throttle and a return throttle; and a plurality of armatures disposed between the solenoid unit and the valve body to be able to adjust the amount of fuel that is discharged through the return throttle by being driven by the plurality of solenoids of the solenoid unit, wherein the plurality of solenoids include an inner solenoid and an outer solenoid that are respectively disposed inside and outside and are coaxially formed, and wherein the plurality of armatures include an inner armature that is driven by the inner solenoid and an outer armature that is driven by the outer solenoid.

2. The fuel injector of claim 1, wherein the inner armature and the outer armature are configured such that the inner armature is operated when the outer armature is driven by the outer solenoid.

3. The fuel injector of claim 2, wherein the inner armature has a cylinder portion and a flange radially extending outward from the cylinder portion, and the outer armature has a sleeve portion surrounding the cylinder portion of the inner armature and a cup portion formed on the sleeve portion and configured to receive the flange to be able to move the flange toward the solenoid unit.

4. The fuel injector of claim 3, wherein the inner height of the cup portion of the outer armature is larger than the thickness of the flange of the inner armature with ends, which face the inner armature and the outer armature, of the inner solenoid and the outer solenoid positioned in the same plane.

5. The fuel injector of claim 3, wherein the valve body comprises a wall surrounding the sleeve portion of the outer armature and a seat formed on the top of the wall, and wherein at least a discharge hole is formed through the wall for returning fuel that is discharged through the return throttle.

6. The fuel injector of claim 5, wherein the downward extension length of the sleeve portion of the outer armature is sized such that the sleeve portion of the outer armature does not close the at least a discharge hole.

7. The fuel injector of claim 6, wherein the sleeve portion of the outer armature is formed to protrude toward the at least a discharge hole with the bottom of the cup portion of the outer armature supported by the top of the seat of the valve body in order to be able to make sure that the at least a discharge hole are open and to partially interfere with flow of the fuel that flows from the return throttle to the at least a discharge hole.

8. The fuel injector of claim 6, wherein the valve body comprises at least a discharge hole, and the control chamber is serially connected to the return throttle and the discharge hole such that the control chamber, the return throttle and the at least a discharge hole provide a return channel, wherein the length of the cylinder portion of the inner armature is determined to be able to close the return channel when the inner and outer solenoids does not operate.

9. The fuel injector of claim 3, further comprising a valve spring that is configured to apply elastic force to push the inner armature toward the valve body.

10. The fuel injector of claim 1, wherein the valve body comprises at least a discharge hole, and the control chamber is serially connected to the return throttle and the discharge hole such that the control chamber, the return throttle and the at least a discharge hole provide a return channel, wherein each of the plurality of armatures corresponds one of the plurality of solenoids and is configured to move by the operation of the corresponding solenoid, wherein the plurality of solenoids are configured to independently operate by at least one control signal such that the operation of one or more of the plurality of solenoids causes one or more of the plurality of armatures to move for adjusting opening of the return channel and further such that the amount of fuel that is discharged through the return throttle by the operation of the plurality of solenoids is controlled.

* * * * *